US009553354B2

(12) United States Patent
Bedicks Junior et al.

(10) Patent No.: US 9,553,354 B2
(45) Date of Patent: Jan. 24, 2017

(54) DIGITAL TV ANTENNA

(71) Applicant: Instituto Presbiteriano Mackenzie, Sao Paulo (BR)

(72) Inventors: Gunnar Bedicks Junior, São Paulo (BR); Cristiano Akamine, São Paulo (BR); Guido Stolfi, São Paulo (BR); Ariston Leite Pereira, São Paulo (BR)

(73) Assignee: Instituto Presbiteriano Mackenzie, Sao Paulo-Sp (BR)

( * ) Notice: Subject to any disclaimer, the term of this patent is extended or adjusted under 35 U.S.C. 154(b) by 278 days.

(21) Appl. No.: 14/205,912

(22) Filed: Mar. 12, 2014

(65) Prior Publication Data

US 2014/0266971 A1 Sep. 18, 2014

(30) Foreign Application Priority Data

Mar. 13, 2013 (BR) ..... 10 2013 0059820

(51) Int. Cl.
*H01Q 1/24* (2006.01)
*H01Q 1/12* (2006.01)
*H01Q 9/32* (2006.01)

(52) U.S. Cl.
CPC ..... *H01Q 1/24* (2013.01); *H01Q 1/1221* (2013.01); *H01Q 9/32* (2013.01)

(58) Field of Classification Search
None
See application file for complete search history.

(56) References Cited

U.S. PATENT DOCUMENTS

2007/0035467 A1* 2/2007 Chen ..... H01Q 9/34 343/900
2008/0012788 A1* 1/2008 Brocheton ..... H01Q 1/1207 343/906

FOREIGN PATENT DOCUMENTS

BR PI09047352 A2 7/2011

* cited by examiner

*Primary Examiner* — Robert Karacsony
(74) *Attorney, Agent, or Firm* — Dinsmore & Shohl LLP

(57) ABSTRACT

The present antenna comprises a metallic base, defining an inner housing; an irradiating element, in the form of a metallic rod, having one end to be secured, in an electrically insulated manner, to the base; and a coaxial cable to connect the antenna to the TV set and having a mesh and a central wire, respectively and electrically connected to the base and to the irradiating element, in the interior of the housing. The antenna further comprises an electronic circuit located in the interior of the housing and having an input connected to the end of the rod, and an output connected to the central wire of the coaxial cable, said electronic circuit blocking the passage of signals in undesired frequencies, from the irradiating element to the coaxial cable.

7 Claims, 5 Drawing Sheets

DIGITAL TV ANTENNA

CROSS-REFERENCE TO RELATED APPLICATIONS

This Application claims priority for Application BR 10 2013 005982 0 filed on Mar. 13, 2013 in Brazil, the contents of which are incorporated herein by reference.

FIELD OF THE INVENTION

The present invention refers to an antenna for the reception of digital TV signals having horizontal, vertical, circular or elliptical polarization, in internal residential or commercial environments, outer environments, or for use in vehicles, said antenna having a robust construction, simple and of easy installation by means of a structure of relatively reduced dimensions and of pleasant presentation, further presenting an inner filter to avoid the interference of undesirable signals.

BACKGROUND OF THE INVENTION

With the population growth in large cities and the consequent increase in residential units located in apartment buildings, it is thus fundamental the use of indoor antennas for the reception of the Digital TV signal in the television sets, in view of the difficulty in installing an outdoor antenna in the buildings and condominiums, or in having collective distribution systems of good quality. The signal received from the television broadcasts may have vertical, horizontal, circular or elliptical polarization, according to the polarization used in the broadcaster antenna, or due to degradation caused to the waves by the multiple reflections of the signal in several obstacles, such as buildings, hills, etc.

Another feature of the antennas commonly used, either indoor or outdoor, consists in the fact that they were designed for receiving analog TV, and are expected to be able to receive signals in all the corresponding frequency ranges, that is, from 54 MHz (channel 2) up to 806 MHz (channel 69).

In Brazil, however, the digital TV uses only the frequency ranges from 174 MHz (channel 7). Thus, the conventional antennas will supply a digital receiver with unneeded signals, which may cause intermodulation and other types of interferences. Particularly, it is known that radio broadcasting signals in Frequency Modulated (FM), which occupy the frequency range from 88 MHz to 108 MHz, significantly impair the digital TV reception in most of the devices commercialized in the country.

Other signals that may potentially interfere in the reception, besides the FM broadcasters and the analog TV channels (channels 2 to 6), comprise those signals related to the communication systems used by the Firefighters, Police, Air Traffic, etc. These services use frequency ranges situated between 108 and 174 MHz.

A known and usual antenna construction for reception of the analog or digital TV signal in indoor environments comprises the provision of a dipole having one fourth of the wave length of the signal to be received, as schematically illustrated in FIG. 1 of the attached drawings. This known antenna construction includes a base 1, a support structure 2 and two irradiating elements 3, whose lengths may be adjusted according to the channel being tuned. The coaxial cable 4 feeding the television set receiver has the outer mesh thereof connected to one of the irradiating elements 3, and the central conductor of the coaxial cable 4 is connected to the other irradiating element 3.

In the type of prior art construction illustrated in FIG. 1, the antenna receives the signals having a field polarization direction parallel to the irradiating elements 3. However, the conventional TV broadcasts may include the emission of waves having a vertical, circular or elliptical polarization. Thus, in case the antenna needs to receive the different types of signal coming from different transmitter stations, or even the reflected signals, the angle of reception of the antenna has to be adjusted for each type of polarization.

In the exemplary construction illustrated in FIG. 1, the antenna may receive, clearly, the horizontally polarized signals. However, the antenna is not able to simultaneously receive signals having polarizations other than the horizontal. In this case, in which it is only possible an adequate reception of horizontally polarized signals, all the receptions have to be mandatorily made horizontally. These antennas do not have means to allow the user to receive signals in multiple and different polarizations.

Besides the operational limitation mentioned above, this known type of antenna has a dimension and shape which makes difficult the aesthetic harmonization with the indoor environment in which they are installed. Another drawback of these known antennas is due to the fact that they are not suitable to be installed outdoors or in vehicles.

Another important factor that degrades the digital TV signal reception is the interference caused by the FM radio transmitters. These hi-power analog signals, irradiated by the transmission antennas of the FM stations scatter throughout the spectrum and interfere in the reception of the digital TV signals. This reason alone is sufficient to disqualify said known indoor antennas, once they do not have filters to eliminate said problem.

Aiming to eliminate the limitations related to signal reception and also to outdoor or vehicular installation of the known antennas mentioned above, it was developed the antenna object of the Brazilian patent application PI0904735-2, which discloses a low cost, reduced size and easily installable antenna construction, and which is adjustable to provide a simultaneous reception of signals transmitted with horizontal, vertical, circular or elliptical polarizations, that is, an omnidirectional antenna construction which allows for an adequate reception in the full bandwidth of the digital TV, for example, the range from 174 MHz to 806 MHz.

Said second antenna construction provides a base 1, made of metal and superiorly carrying a hinge 5 in which is mounted an irradiating element 3, in the form of a metallic rod and which may be displaced between operational positions, in which it forms an angle between zero and 90° in relation to the plane of the base. The coaxial cable C connected to the receiver device of the TV signals has its mesh M electrically connected to the base 1, and its central wire F connected to the irradiating element 3 through said hinge 5. This prior construction further comprises an annular permanent magnet 6 mounted on the base 1 and inside a housing 7.

Although eliminating some of the disadvantages of the previous antennas, said last construction still presents a few drawbacks, including a relevant signal loss through the hinge, especially over time and with a progressive deterioration of the elements articulated to each other.

Moreover, said previous construction is relatively complex, using multiple elements for building the base and for promoting the connection of the elements of the coaxial cable to the metallic base and to the irradiating element through the hinge, adding cost to the product and impairing the integral transmission of the incoming signals to the coaxial cable connected to the receiver device.

Still another drawback of said prior solution is related to the fact that it does not include any filter element provided between the irradiating element and the coaxial cable, in order to block de radio broadcast signals in modulated frequency occupying the frequency range from 88 MHz to 108 MHz, which, as mentioned before, significantly impair the reception of the digital TV signals in most part of the devices sold in Brazil. The filters provided inside the receiver device itself are not able to prevent undesirable interferences of said radio broadcast signals in the reception of the digital TV signals.

SUMMARY OF THE INVENTION

Due to the limitations and drawbacks of the known antennas for digital TV, the present invention has the object of providing a type of antenna which presents ease of installation, indoor or outdoor use, fixed or mobile application, reduced size construction, simultaneous and suitable reception in the full bandwidth of the digital TV signals, usually in the range from 174 MHz to 806 MHz, of the signals transmitted with horizontal, vertical, circular or elliptical polarization, and which is able to block the undesirable signals, for example, the radio broadcast signals in the frequency range from 88 MHz to 108 MHZ, before said signals reach the coaxial cable which connect the antenna to the receiver device.

The present invention is related to a digital TV antenna of the type comprising a metallic base, defining an inner housing; an irradiating element, in the form of a metallic rod, having one end to be affixed, in an electrically insulated manner, to the base; and a coaxial cable to connect the antenna to the TV set and having a mesh and a central wire, which are respectively and electrically connected to the base and to the irradiating element, in the interior of the housing.

According to the invention, the antenna further comprises an electronic circuit located in the interior of the housing and having an input connected to the end of the rod and an output connected to the central wire of the coaxial cable, said electronic circuit blocking the passage of signals in undesired frequencies, from the irradiating element to the coaxial cable.

BRIEF DESCRIPTION OF THE DRAWINGS

The invention will be described below with reference to the attached drawings, given by way of example of a possible way of carrying out the antenna, and in which.

DETAILED DESCRIPTION OF THE PREFERRED EMBODIMENTS

Figure 1:
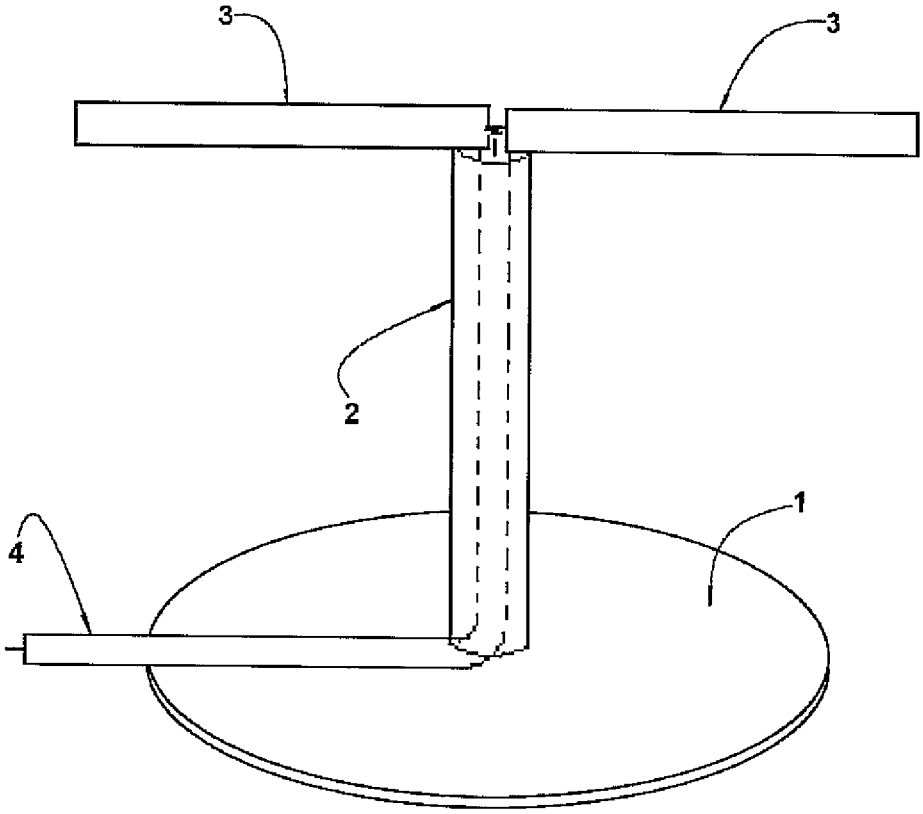
FIG. 1 PRIOR ART
FIG. 1 represents a schematic and simplified perspective view of an antenna built according to a first prior art.
Figure 2:
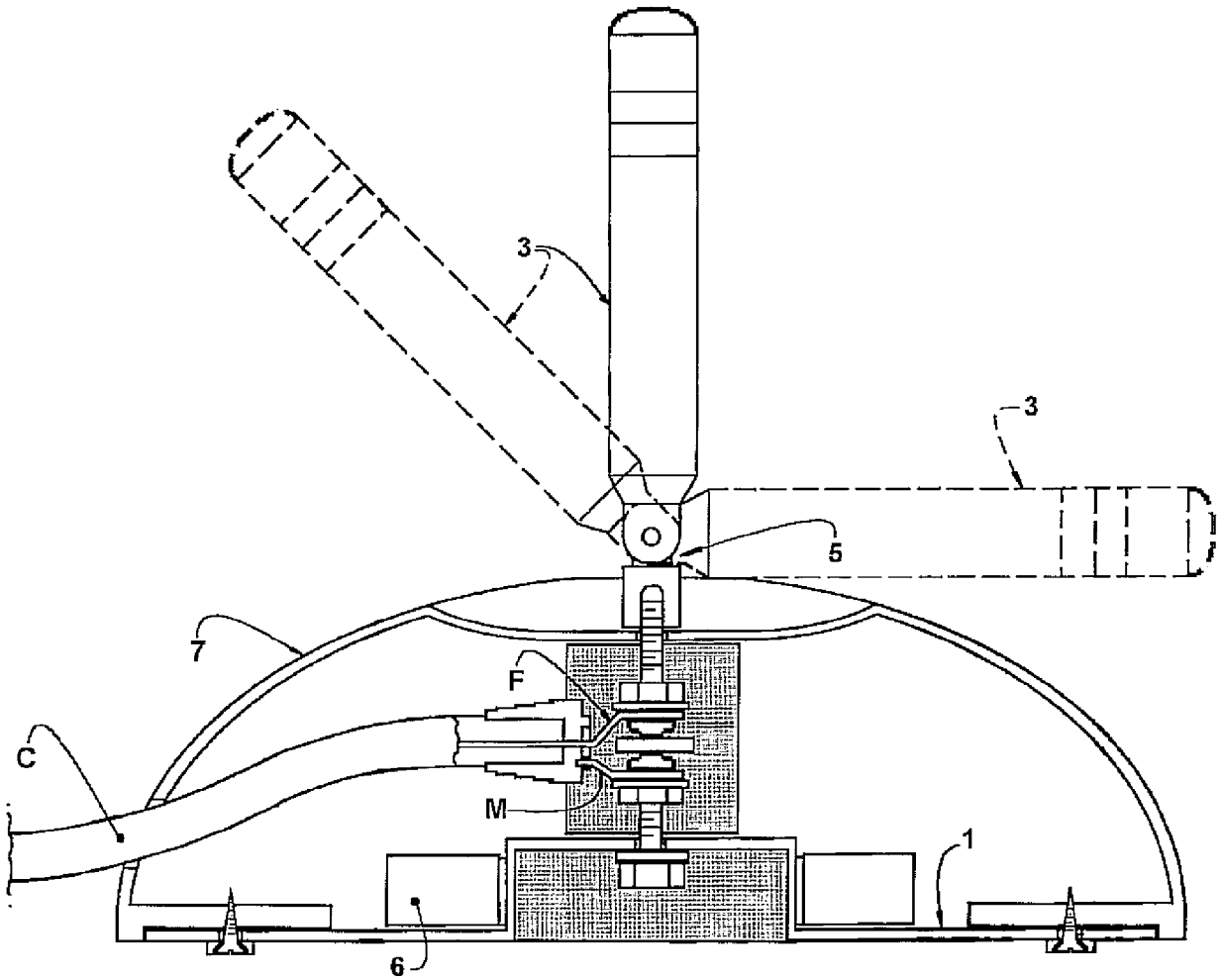
FIG. 2 PRIOR ART
FIG. 2 represents a longitudinal vertical cross-sectional view of a second prior art, further illustrating, with a continuous line, the single irradiating element in a vertical position and, with dashed lines, the same irradiating element in the inclined and horizontal positions.
Figure 3:
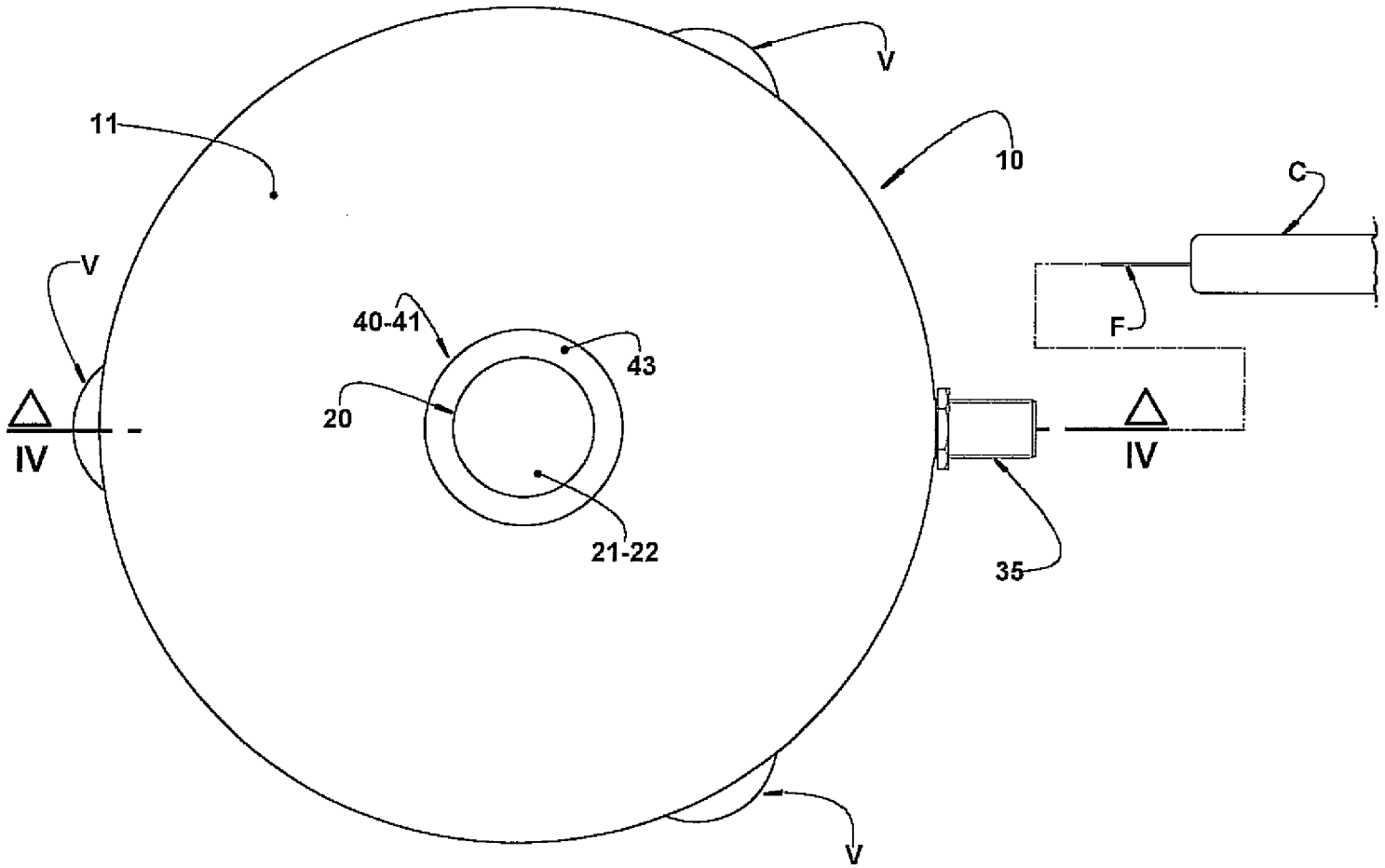
FIG. 3 represents an upper plan view of the antenna built according to the present invention.
Figure 4:
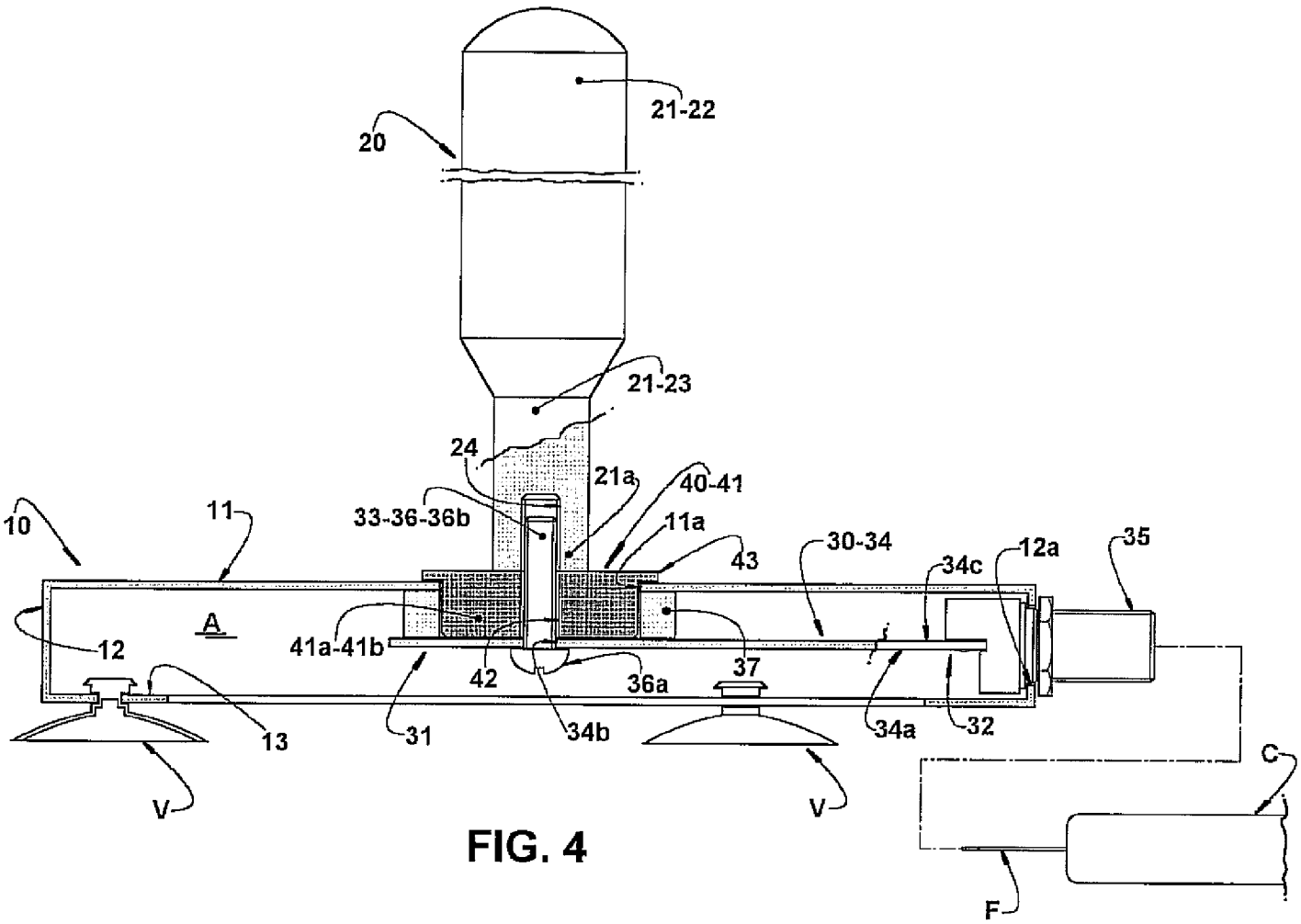
FIG. 4 represents a partial longitudinal vertical cross-sectional view of the present antenna, said view being taken according to line IV-IV in FIG. 3.
Figure 5:
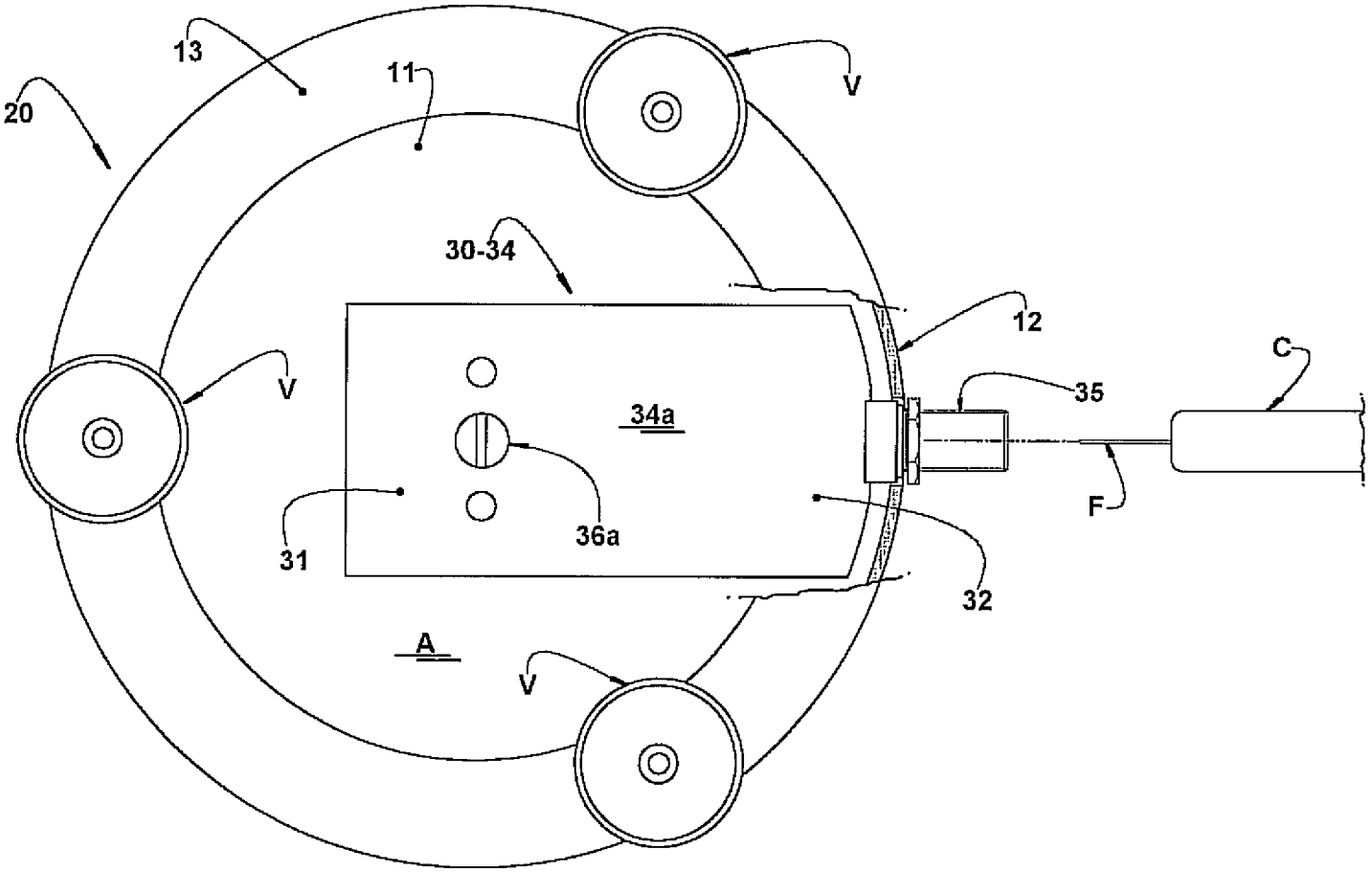
FIG. 5 represents a partially cut lower plan view of the metallic base of the antenna, illustrating the printed circuit board of the frequency filter, incorporating a threaded connector which projects radially outwards from the base in order to receive the coaxial cable.

As illustrated in the attached drawings, the present digital TV antenna comprises a metallic base 10, preferably pressed from an aluminum plate having a thickness for example of 2 mm and having, for example, a substantially circular contour, said base 10 internally defining a housing A.

The base 10 comprises a top wall 11 provided with a through hole 11*a*, which limits, superiorly, the housing A and incorporates, in a peripheral edge, a skirt 12 which peripherally limits the housing A and presents a radial window 12*a*. The skirt 12 incorporates, inferiorly and internally, an annular flange 13 which may act as a support for the attachment of a bottom wall, not illustrated, inferiorly closing the housing A, and defining the lower surface of the base 10.

The annular flange 13 may further carry, inferiorly, a plurality of suction cups V for fixing the base 10 on a given support surface.

Although not illustrated herein, the base 10 may have the housing A thereof provided with one or more magnets to allow the magnetic retention of the base 10 on a metallic surface, with no need for using the suction cups V.

The present TV antenna further comprises an irradiating element 20, in the form of a preferably metallic cylindrical rod 21, built in aluminum and having the function of capturing the electromagnetic field provided from the digital TV signal transmitters. The rod 21 of the irradiating element 20 should have its length equivalent to approximately one fourth of the wavelength of the signal to be received by the antenna.

The rod 21 presents one end 21*a* defined in a portion of reduced diameter and to be affixed, in an electrically insulated manner, to the base 10.

A coaxial cable C connects the antenna to the TV set (not illustrated) and presents a mesh (not illustrated) and a central wire F, which are respectively and electrically connected to the base 10 an to the irradiating element 20, in the interior of the housing A.

In a possible construction of the antenna, the irradiating element 20 may have a length of 120 mm, which corresponds to the geometric average of the UHF frequency band of the television transmissions. In the same manner, it may be used a 21 mm diameter for the rod 21 of the irradiating element 20, which diameter is determined to minimize the energy loss in high frequencies due to the skin effect. This means that for said average frequency, the antenna has maximum gain.

The rod 21 of the irradiating element 20 presents an irradiation portion 22 and a fixation portion 23 of reduced diameter in relation to the irradiation portion 21 and having the end 21*a* provided with a threaded axial hole 24, through which the irradiating element 20 is fixed to the base 10, as described further below. The reduction of the diameter between the irradiation portion 22 and the fixation portion 23, as well as their axial extension, is calculated as a function of the effect in the signal reception.

According to the present invention, the TV antenna further comprises an electronic circuit 30 located in the interior of the housing A and having an input 31 connected to the end 21*a* of the rod 21, and an output 32 connected to the central wire F of the coaxial cable C, said electronic circuit 30 blocking the passage of signals in undesired frequencies from the irradiating element 20 to the coaxial cable C.

The electronic circuit 30 includes a fixation element 33 which defines an electrical and mechanical connection between the electronic circuit 30 and the end 21*a* of the rod 21, said electronic circuit 30 being defined, in the illustrated embodiment, by a printed circuit board 34, affixed in the interior of the housing A.

The printed circuit board 34 is provided, in a peripheral portion, for example, in one of its edges, with a connector 35, defining a terminal built in order to receive and secure the end of the coaxial cable C, promoting the retention of the latter, and the electrical connections of the wire F and mesh, respectively to the electronic circuit 30 and to the base 10.

The connector 35 projects radially outward from the base 10, through the radial window 12*a* of the latter, in order to be secured thereto and to receive, externally to the base 10, the adjacent end of the coaxial cable C.

According to one way of carrying out the invention, the fixation element 33 is located through the through hole 11*a* of the top wall 11 of the base 10 and mounted to the base 10 by a positioning means 40, not electrically conductive.

The positioning means 40 comprises, for example, a bushing 41 of electrically insulating material, fitted into the through hole 11*a* of the top wall 11. The bushing 41 is provided with a central hole 42, through which is placed the fixation element 33 which, in the illustrated embodiment, has the shape of a screw 36 having a head 36*a* seated against a lower face 34*a* of the printed circuit board 34, and a threaded body 36*b* passing through a hole 34*b* in the printed circuit board 34, through the central hole 42 of the bushing 41, and threaded inside the threaded axial hole 24 provided in the irradiating element 20 and open to the end 21*a* thereof.

The bushing 41 is formed in polymeric material and presents an end upper flange 43, seated on the top wall 11 of the base 10, around the through hole 11*a*, and onto which is seated the end 21*a* of the irradiating element 20, said bushing 41 having a body 41*a* which projects to the interior of the housing A, in order to define an inner end 41*b* against which is seated the printed circuit board 34, upon the tightening of the screw 36.

The screw 36 is provided in an adequate conductive material such as, for example, copper.

In the illustrated embodiment, the printed circuit board 34 has an upper face 34*c* which secures at least one spacer 37, made of a not electrically conductive material and, for example, in the form of a washer, seated against the top wall 11 of the base 10, in the interior of the housing A, for allowing said printed circuit board 34 to be mounted substantially parallel to the annular flange 13 of the base 10, and also to prevent any load transfer onto the assembly of the screw 36.

After the assembly of the irradiating element 30 on the base 10, the latter may have its housing A, not only inferiorly closed by a non-illustrated bottom wall, but also have said housing A filled with a filling, not illustrated, in unsaturated polyester or other suitable synthetic material not electrically conductive and, for example, injectable. The filling protects the assembly region of the printed circuit, as well as part of the screw against corrosion or other degradation caused by harsh weather conditions.

As it may be observed, the present antenna has an extremely simple and compact construction, allowing for the use of a base 10 with different aesthetic configurations, which may be harmonized with the installation environment, and also installed in outdoor environments, since it is weatherproof.

The present construction further allows the antenna to carry out the suitable reception in electromagnetic fields having vertical, horizontal, circular or elliptical polarization, allowing for a higher gain in comparison to conventional antennas, since it prevents the signals received in the coaxial cable C from including the noises undesirable to the quality of the reception to be supplied to the digital TV receiver.

The invention claimed is:

1. A digital TV antenna comprising a metallic base, defining an inner housing; an radiating element, in the form of a metallic rod, having one end configured to be secured, in an electrically insulated manner, to the base; and a coaxial cable to connect the antenna to a TV set and having a mesh and a central wire, which are respectively and electrically connected to the base and to the radiating element, in the interior of the housing, said antenna being characterized in that it further comprises an electronic circuit located in the interior of the housing and having an input connected to the end of the rod, and an output connected to the central wire of the coaxial cable, said electronic circuit blocking the passage of signals having undesired frequencies, from the radiating element to the coaxial cable; characterized in that the electronic circuit includes a fixation element defining an electrical and a mechanical connection between the electronic circuit and the end of the rod; the electronic circuit is defined by a circuit board affixed in the interior of the housing; the housing provided with a through hole; the base comprises a top wall provided with a through hole through which is located the fixation element.

2. The antenna, according to claim 1, characterized in that a positioning means for mounting the fixation element to the base comprises a bushing of an electrically insulating material, fitted through the through hole of the top wall and provided with a central hole through which is located the fixation element.

3. The antenna, according to claim 2, characterized in that the fixation element takes the form of a screw having a head seated against a lower face of the printed circuit board, and a threaded body, which passes through a hole in the printed circuit board, through the central hole of the bushing, and which is threaded inside a threaded axial hole provided in the radiating element and open to the end thereof.

4. The antenna, according to claim 3, characterized in that the bushing is formed in polymeric material and has an end upper flange, seated on the top wall around the through hole and onto which is seated the end of the radiating element, said bushing having a body projecting to the interior of the housing, in order to define an inner end against which is seated the printed circuit board, upon tightening the screw.

5. The antenna, according to claim 1, characterized in that the printed circuit board has an upper face securing at least one spacer made of a not electrically conductive material, seated against the top wall, in the interior of the housing.

6. The antenna, according to claim 1, characterized in that the base has the top wall thereof incorporating a skirt, peripherally limiting the housing and presenting a radial window, the printed circuit board incorporating, in one of its edges, a connector projecting radially outward from the base through the radial window.

7. The antenna, according to claim 6, characterized in that the skirt incorporates, internally, an annular flange carrying a plurality of suction cups for securing the base on a support surface.

* * * * *